US012790071B2

(12) United States Patent
Davis

(10) Patent No.: US 12,790,071 B2
(45) Date of Patent: Nov. 10, 2026

(54) WINDING ASSEMBLY

(71) Applicant: LOADHOG LIMITED, Sheffield (GB)

(72) Inventor: Luke Davis, Sheffield (GB)

(73) Assignee: LOADHOG LIMITED, Sheffield (GB)

( * ) Notice: Subject to any disclaimer, the term of this patent is extended or adjusted under 35 U.S.C. 154(b) by 422 days.

(21) Appl. No.: 18/559,448

(22) PCT Filed: May 6, 2022

(86) PCT No.: PCT/IB2022/054199

§ 371 (c)(1),
(2) Date: Nov. 7, 2023

(87) PCT Pub. No.: WO2022/234531

PCT Pub. Date: Nov. 10, 2022

(65) Prior Publication Data

US 2024/0239553 A1 Jul. 18, 2024

(30) Foreign Application Priority Data

May 7, 2021 (GB) ..... 2106520
May 5, 2022 (GB) ..... 2206597

(51) Int. Cl.
*B65D 19/38* (2006.01)
*B65D 63/10* (2006.01)
*B65D 71/00* (2006.01)

(52) U.S. Cl.
CPC ..... *B65D 19/38* (2013.01); *B65D 63/10* (2013.01); *B65D 71/0088* (2013.01); *B65D 2571/00111* (2013.01)

(58) Field of Classification Search
CPC .... B65D 19/38; B65D 63/10; B65D 71/0088; B65D 2571/00111
USPC ..... 410/100
See application file for complete search history.

(56) References Cited

U.S. PATENT DOCUMENTS 5,324,063 A * 6/1994 Locantro ..... A63C 11/00 280/809
7,311,484 B2 * 12/2007 Facey ..... B65D 71/0096 410/100
7,476,069 B2 * 1/2009 Facey ..... B60P 7/083 410/100

(Continued)

FOREIGN PATENT DOCUMENTS

GB 2402380 A 12/2004
GB 2474912 A 5/2011

*Primary Examiner* — Amy R Weisberg
*Assistant Examiner* — Daniel R Digiovannantonio
(74) *Attorney, Agent, or Firm* — Clark Hill PLC; James R. Foley

(57) ABSTRACT

A winding assembly (16) comprises a ratchet spool (59) rotatable about a principal axis (61). The ratchet spool (59) has a main part (20) and a plurality of ratchet teeth (60) arranged circumferentially around the main part (20). The winding assembly (16) also has a tensioning arrangement (37) for tensioning an elongate article (10). The winding assembly (16) further includes a drive arrangement (18) to engage the ratchet teeth (60) of the ratchet spool (59) and rotate the ratchet spool (59) in a driving direction about said principal axis (61) to apply tension to the elongate article (10). A tension limitation member (53) is provided between the ratchet spool (59) and the tensioning arrangement (37) to limit the tension applied to the elongate article (10).

19 Claims, 12 Drawing Sheets

(56) References Cited

U.S. PATENT DOCUMENTS 8,454,285 B2 * 6/2013 Jackson ..... B65D 21/064
410/98

* cited by examiner

WINDING ASSEMBLY

RELATED/PRIORITY APPLICATION

This application is a National Phase filing regarding International Application No. PCT/IB2022/054199, filed on May 6, 2022, which relies upon Great Britain Application No. 2106520.6, filed on May 7, 2021, and Great Britain Application No. 2206597.3, filed on May 5, 2022, for priority.

This invention relates to winding assemblies. More particularly, but not exclusively, this invention relates to tightening arrangements incorporating winding assemblies. This invention also relates to lids incorporating such winding assemblies.

It is known to load goods on pallets. Lids can be mounted on the loads. Such lids are provided with straps to tighten the lid against the load. The lids include tightening mechanisms, operated by levers, to tighten the strap, thereby pulling the lid against the load. In some situations, the strap can be overtightened. An example of a winding assembly is disclosed in GB2402380 A.

According to one aspect of this invention, there is provided a winding assembly comprising:

- a ratchet spool rotatable about a principal axis, said ratchet spool having a main part and a plurality of ratchet teeth arranged circumferentially around the main part;
- a tensioning arrangement for tensioning an elongate article;
- a drive arrangement to engage the ratchet teeth of the ratchet spool and rotate the ratchet spool in a driving direction about said principal axis to apply tension to the elongate article; and
- a tension limitation member between the ratchet spool and the tensioning arrangement to limit the tension applied to the elongate article.

The tensioning arrangement may comprise a tensioner. The drive arrangement may comprise a driver. The tension limitation member may comprise a tension limiter.

According to another aspect of this invention, there is provided a winding assembly comprising:

- a ratchet spool rotatable about a principal axis, said ratchet spool having a main part and a plurality of ratchet teeth arranged circumferentially around the main part;
- a tensioner for tensioning an elongate article;
- a driver to engage the ratchet teeth of the ratchet spool and rotate the ratchet spool in a driving direction about said principal axis to apply tension to the elongate article; and
- a tension limiter between the ratchet spool and the tensioning arrangement to limit the tension applied to the elongate article.

The winding assembly may comprise a transmission arrangement between the ratchet spool and the tensioning arrangement. The transmission arrangement may comprise a force transmitter.

According to another aspect of this invention, there is provided a winding assembly comprising:

- a ratchet spool rotatable about a principal axis, said ratchet spool having a main part and a plurality of ratchet teeth arranged circumferentially around the main part;
- a tensioning arrangement for tensioning an elongate article;

- a transmission arrangement between the ratchet spool and the tensioning arrangement;
- a drive arrangement to engage the ratchet teeth of the ratchet spool and rotate the ratchet spool in a driving direction about said principal axis to apply tension to the elongate article; and
- a tension limitation member to limit the tension applied by the tensioning arrangement.

According to another aspect of this invention, there is provided a method of using a winding assembly as described above, wherein the transmission arrangement comprises the tension limitation member; the method comprising: driving the ratchet spool to fully unwind the tension limitation member from the tensioning arrangement whereby, when so unwound, further driving of the ratchet spool causes tension to be applied to the tension limitation member, thereby preventing further rotation of the ratchet spool.

According to another aspect of this invention, there is provided a method of using a winding assembly as described above, wherein the transmitter comprises the tension limitation member; the method comprising: driving the ratchet spool to fully unwind the tension limiter from the tensioner whereby, when so unwound, further driving of the ratchet spool causes tension to be applied to the tensioner, thereby preventing further rotation of the ratchet spool.

According to another aspect of the invention, there is provided a lid comprising:

- a body;
- an elongate article within the body, the elongate article being movable between a retracted condition in which the elongate article is retracted within the body, and an extended condition in which the elongate article extends from the body; and
- a winding assembly as described above operable on the elongate article.

The tension limitation member may be movable between a release condition and a tension applying condition. In said tension applying condition, a predetermined maximum tension may be applied to the elongate article. The tension limitation member may be moved to the tension applying condition when the ratchet spool is rotated in the driving direction.

The rotation of the ratchet spool in said driving direction may be transmitted by the transmission arrangement to the tensioning arrangement to drive the tensioning arrangement rotatably in a winding direction to wind the elongate article around the tensioning arrangement.

The ratchet spool may have a first attaching formation to attach the transmission arrangement to the ratchet spool. The tensioning arrangement may have a second attaching formation to attach the transmission arrangement to the tensioning arrangement.

The transmission arrangement may comprise the tension limitation member. The tension limitation member may comprise a transmission member. The tension limitation member may be elongate. The tension limitation member may comprise a linkage, which may comprise a flexible elongate linkage, such as a wire, cable or wire rope.

The first attaching formation may comprise a first annular groove formation defined by the main part. The first attaching formation may have a first diameter. The first attaching formation may extend circumferentially around the main part.

The tension limitation member may be received in the first attaching formation when the ratchet spool is rotated in the driving direction. The tension limitation member may be wound around the first attaching formation when the ratchet spool is rotated in the driving direction.

The first attaching formation may include a first bore defined by the ratchet spool. The first bore may be a through bore. The first bore may be defined by the main part.

The first bore may open into the first attaching formation. An end region of the tension limitation member may be received in the first bore to attach the tension limitation member to the ratchet spool.

The ratchet teeth may be spaced circumferentially around the main part. The ratchet teeth may extend radially from the main part. The main part may be substantially cylindrical.

The plurality of ratchet teeth may comprise between four and ten of the ratchet teeth. Optionally, the plurality of ratchet teeth may comprise between four and eight of the ratchet teeth. Desirably, the plurality of ratchet teeth may comprise between four and six of the ratchet teeth. In one embodiment, the plurality of ratchet teeth may comprise four of the ratchet teeth.

The ratchet teeth may be spaced circumferentially around the main part. The ratchet teeth may be equispaced circumferentially around the main part by substantially 90°.

The teeth may be spaced by a distance such that when the tension limitation member is fully unwound from the tensioning arrangement, tension is applied to the tension limitation member between the first and second attaching formations, thereby preventing further rotation of the ratchet spool.

The main part may include a toothed portion and a base portion. The ratchet teeth may be provided on the toothed portion.

The base portion may be provided at one end of the toothed portion. The first attaching formation may be defined between the toothed portion and the base portion.

The second attaching formation may comprise a second attaching formation. The tension limitation member may extend around the second attaching formation.

The tension limitation member may be wound around the second attaching formation when the tension limitation member is in the release condition. The second attaching formation may have a second diameter.

The tension limitation member may be unwound from the second attaching formation when the tensioning arrangement is rotated in the winding direction. The tension limitation member may be fully unwound from the second attaching formation when the tension limitation member is in the tension applying condition.

The ratchet spool may be driven to fully unwind the tension limitation member from the tensioning arrangement whereby, when so unwound, further driving of the ratchet spool causes tension to be applied to the tension limitation member, thereby preventing further rotation of the ratchet spool.

The tension limitation member is preferably of a predetermined length to limit the extent to which the drive arrangement can rotate the ratchet spool. The predetermined length of the tension limitation member may be such as to permit a predetermined number of rotations of the ratchet spool.

The predetermined length of the tension limitation member may be such that the tension limitation member is fully unwound from the second attaching formation after said predetermined number of rotations of the ratchet spool, and tension is applied to the tension limitation member, thereby preventing further rotation of the ratchet spool.

The predetermined length of the tension limitation member may be such that the tension limitation member extends only once around the first attaching formation.

The predetermined length of the tension limitation member may be selected such that said predetermined number of rotations of the ratchet spool may drive the tensioning arrangement a predetermined number of rotations of the tensioning arrangement.

The second attaching formation may comprise a second bore defined by the tensioning arrangement. The second bore may open into the second attaching formation. Thus, an end region of the tension limitation member may be received in the second bore, thereby attaching the tension limitation member to the tensioning arrangement.

The drive arrangement may comprise a ratchet arrangement. The ratchet arrangement may have an operating member.

The ratchet arrangement may comprise a drive pawl to engage the ratchet teeth. The operating member may effect movement of the drive pawl into engagement with the ratchet teeth.

The operating member may comprise a lever. The lever may be pivotally movable about the principal axis.

The operating member may be movable from an inoperative position to an operative position. Movement of the operating member from the inoperative position to the operative position causes the ratchet arrangement to engage one of the ratchet teeth. The engagement of the operating member with the ratchet tooth may rotate the ratchet spool.

The winding assembly may include a return element for returning the operating member to the inoperative position. The return element may be resilient. The return element may comprise a spring, such as a coil spring.

The winding assembly may further include a second return element for rotating the tensioning arrangement in the opposite direction to the winding direction. The second return element may comprise a second coil spring.

The tension limitation member may constitute a stop to prevent further rotation of the ratchet spool. Desirably, the operating member may be pivoted four times between the rest and projecting positions to unwind the tension limitation member fully from the second attaching formation.

The tension limitation member may extend only once around the first attaching formation when the tension limitation member is fully unwound from the second attaching formation. This may cause the ratchet spool to be rotated substantially 360°.

The elongate article may comprise an elongate tensioning member. The winding assembly may constitute a tightening assembly for tightening the elongate tensioning member. The tightening assembly may tighten the elongate article when the elongate tensioning member is secured to a pallet.

The tensioning arrangement may comprise a slotted member. The elongate article may comprise a strap. The elongate article may extend through the slotted member. The slotted member may have a longitudinal axis about which the slotted member can rotate.

Rotation of the slotted member may cause the tensioning member to be wound around the slotted member, thereby applying tension to the elongate article. The slotted member may comprise an elongate spindle defining a slot through which the elongate article passes. The spindle may have a third diameter.

At least one embodiment of the invention will now be described by way of example only, with reference to the accompanying drawings, in which.

Figure 1:
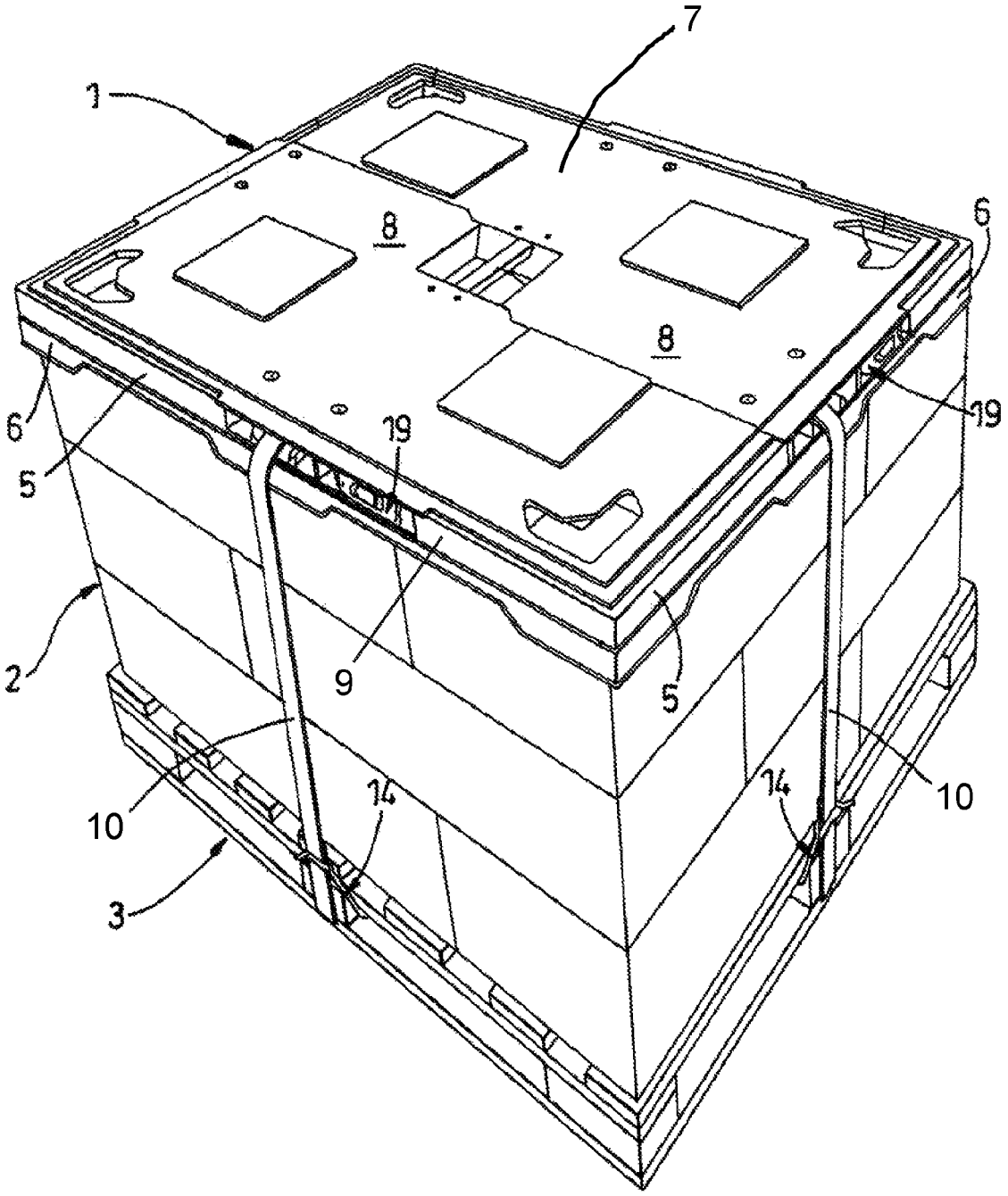
FIG. 1 is a perspective view of a lid in use on a load.

FIG. 1 shows a lid 1 for securing a load 2 on a pallet 3. The lid 1 comprises a body 4 with upstanding sides 5 and a downwardly extending skirt 6 for embracing the top sides of the load (and also enabling a plurality of the lids 1 to be nested with each other or with pallets).

The body 4 comprises an upper portion 7 shown formed by two plastics mouldings 8, but which could be formed as a single moulding. The body 4 further includes a lower portion 9 formed by a main plastics moulding.

The lid 1 includes four elongate tensioning members in the form of straps 10. Each strap 10 is movable between a retracted condition within the upper portion 7, and an extended condition in which the strap 10 extends from the upper portion 7. Each strap 10 is provided at a respective side of the lid 1.

Each strap 10 has a distal end to which a terminating element 14 is attached. In the extended condition of the straps 10, the terminating elements 14 can be secured to the pallet 3. Each strap 10 also has a proximal end attached to a drum 12.

In some embodiments, the terminating elements 14 are in the form of hooks (see FIGS. 1 and 4) which can be secured to an edge of a pallet 3. In other embodiments, the terminating elements are in the form of loops (see, for example, FIGS. 2 and 3), which can be secured to a securing member (not shown) on a pallet.

Urging means (not shown), in the form of a spring, urges the drum 12 in a direction to wind the strap 10 thereon, to move the strap 10 to its retracted condition.

Only two of the straps 10 are visible in FIG. 1, extending from two of the sides of the body 4. The skilled person will realise that the other two straps 10 extend from the other two sides.

When the terminating elements 14 are secured to the pallet 3, the straps 10 can be tensioned by the use of respective winding assemblies 16 operable on each strap 10. Each winding assembly 16 is provided within the body 4.

Each winding assembly 16 comprises a tensioning arrangement in the form of a slotted member 37 (see, for example, FIGS. 2 and 3) and a drive arrangement in the form of a ratchet arrangement 18. The slotted member 37 is rotatably mounted on the body 4.

The slotted member 37 is rotatable by operation of the ratchet arrangement 18, which comprises an operating member in the form of a lever 19.

The winding assembly 16 further includes a ratchet spool 59 mounted adjacent the lever 19 for rotation about a principal axis 61. The ratchet arrangement 18 is operable on the ratchet spool 59 to rotate the ratchet spool 59, as explained below.

The ratchet spool 59 has a main part 20. The main part 20 comprises a base portion 25 and a substantially cylindrical toothed portion 27. Four ratchet teeth 60 are provided on the toothed portion 27. The ratchet teeth 60 extend outwardly from the toothed portion 27, and are spaced circumferentially around the main part 20 by about 90°.

The base portion 25 is provided at one end of the toothed portion 27. A first attaching formation in the form of a first annular groove formation 58 is defined between the toothed portion 27 and the base portion 25.

The ratchet teeth 60 are provided between the first annular groove formation 58 and the opposite end of the main part 20. The first annular groove formation 58 has a first diameter.

Figure 3:
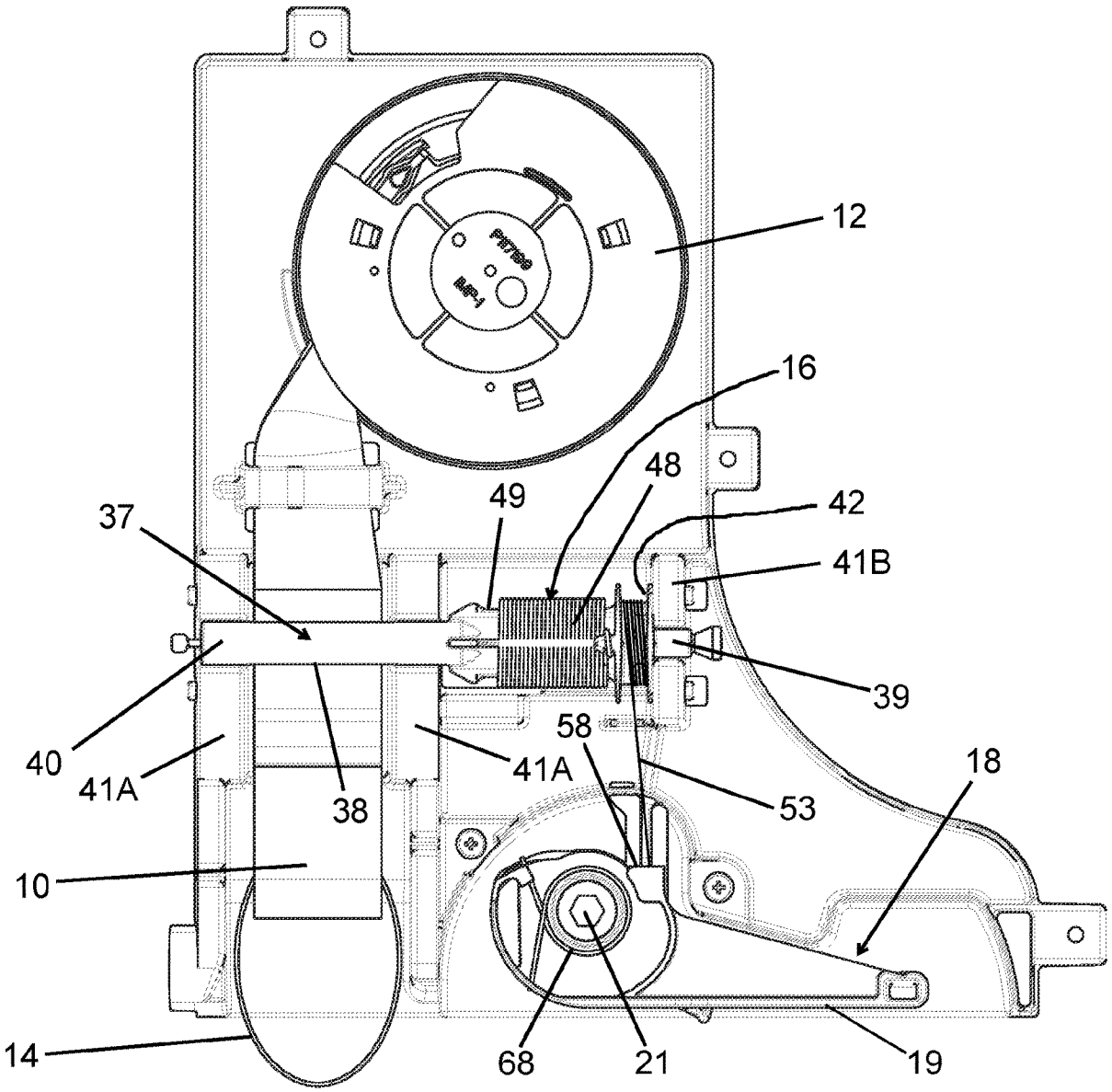
FIG. 3 is a plan view of the winding assembly.
Figure 4:
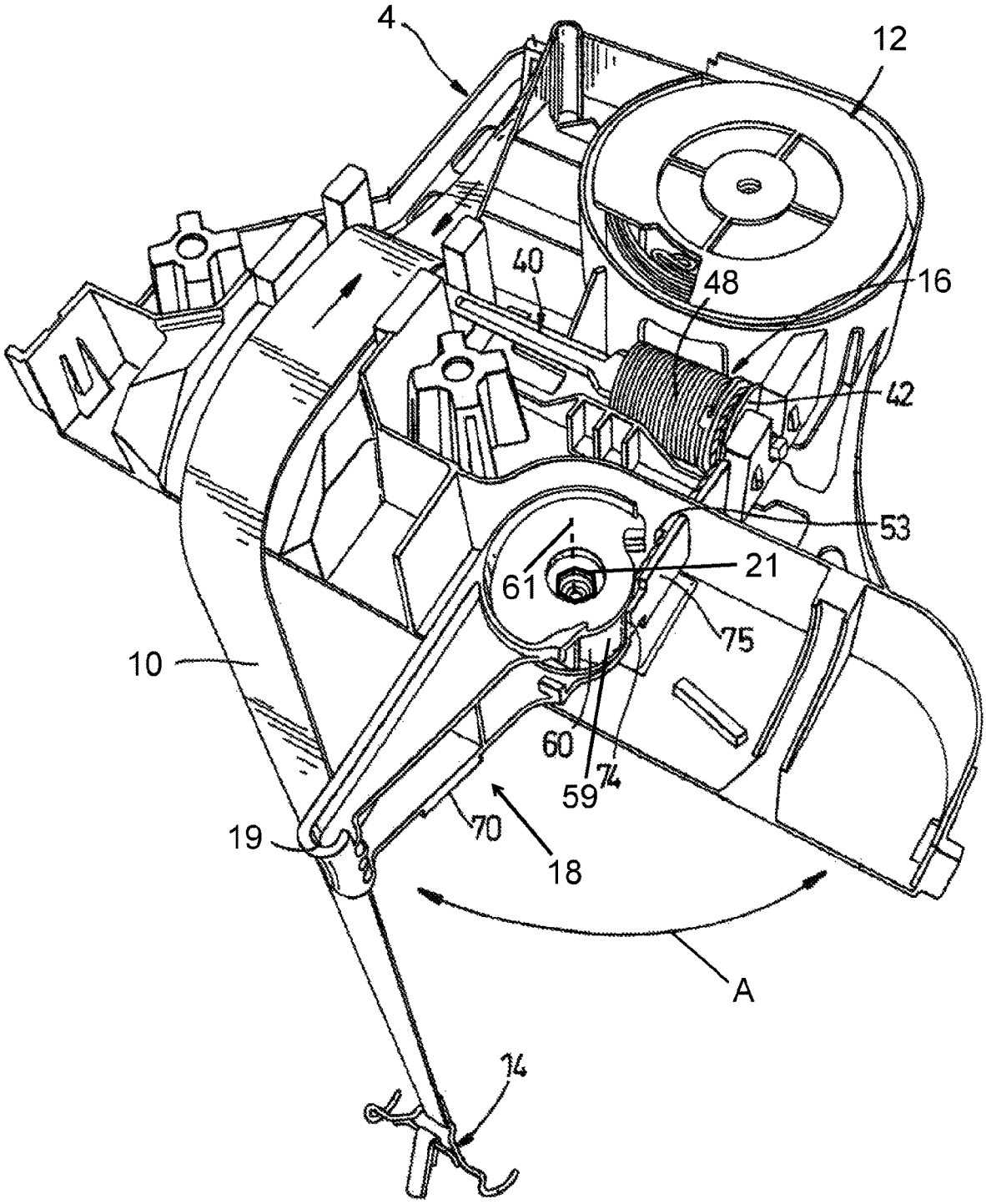
FIG. 4 shows the winding assembly in use, in which an elongate tensioning member is attached to a pallet.
Figure 5:
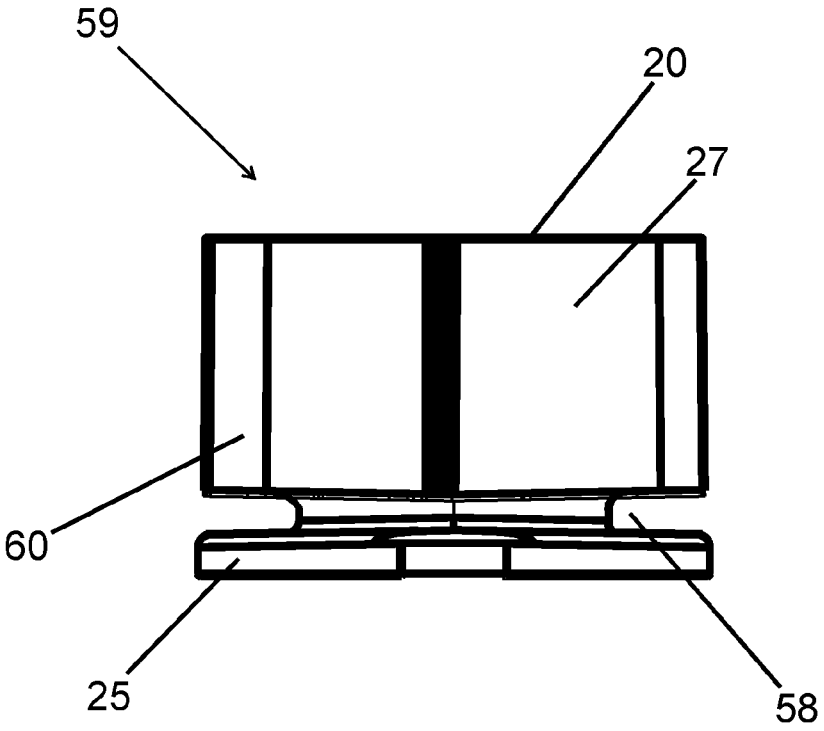
FIG. 5 is a close up view of a ratchet spool.
Figure 9:
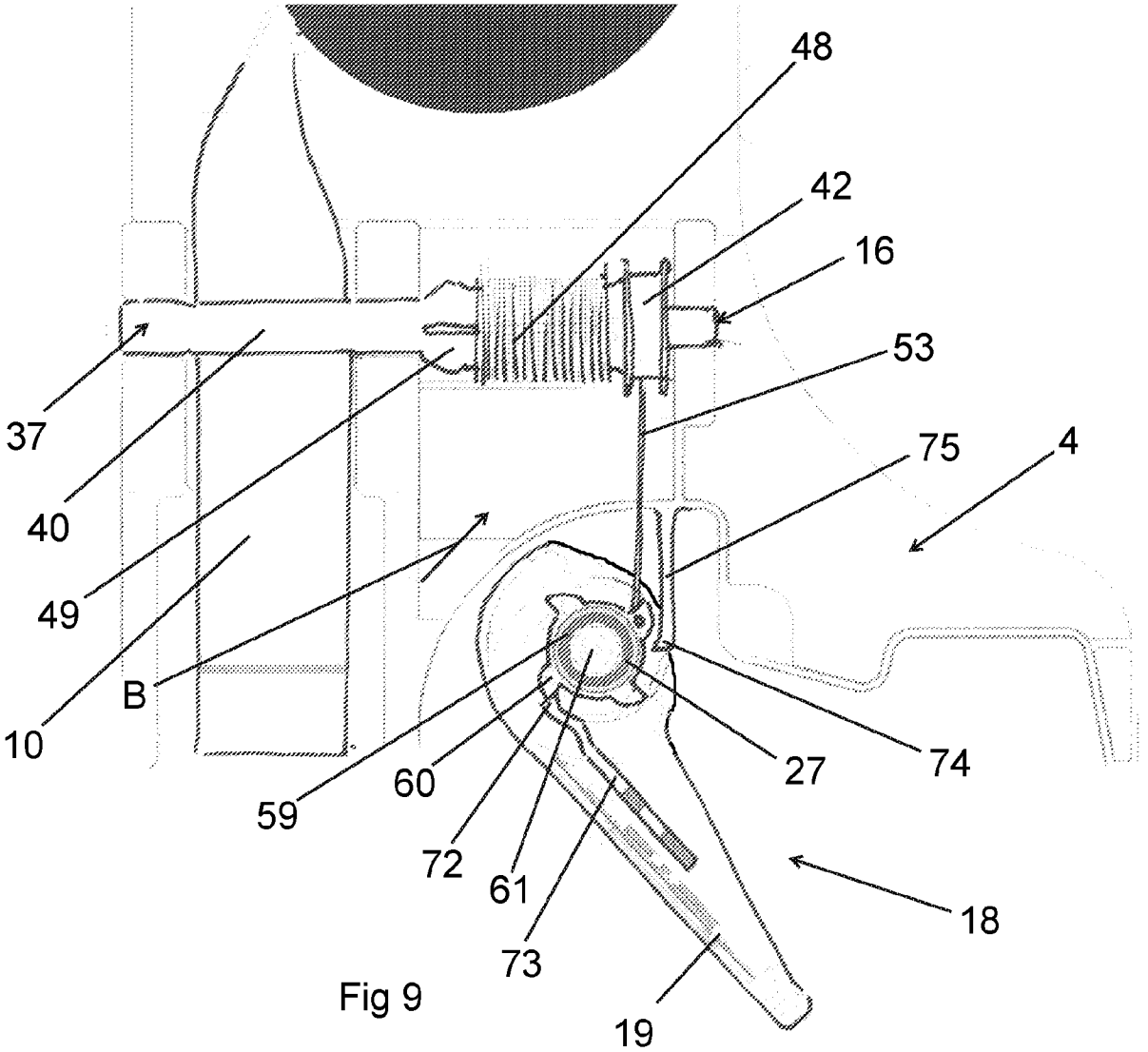
Figure 10:
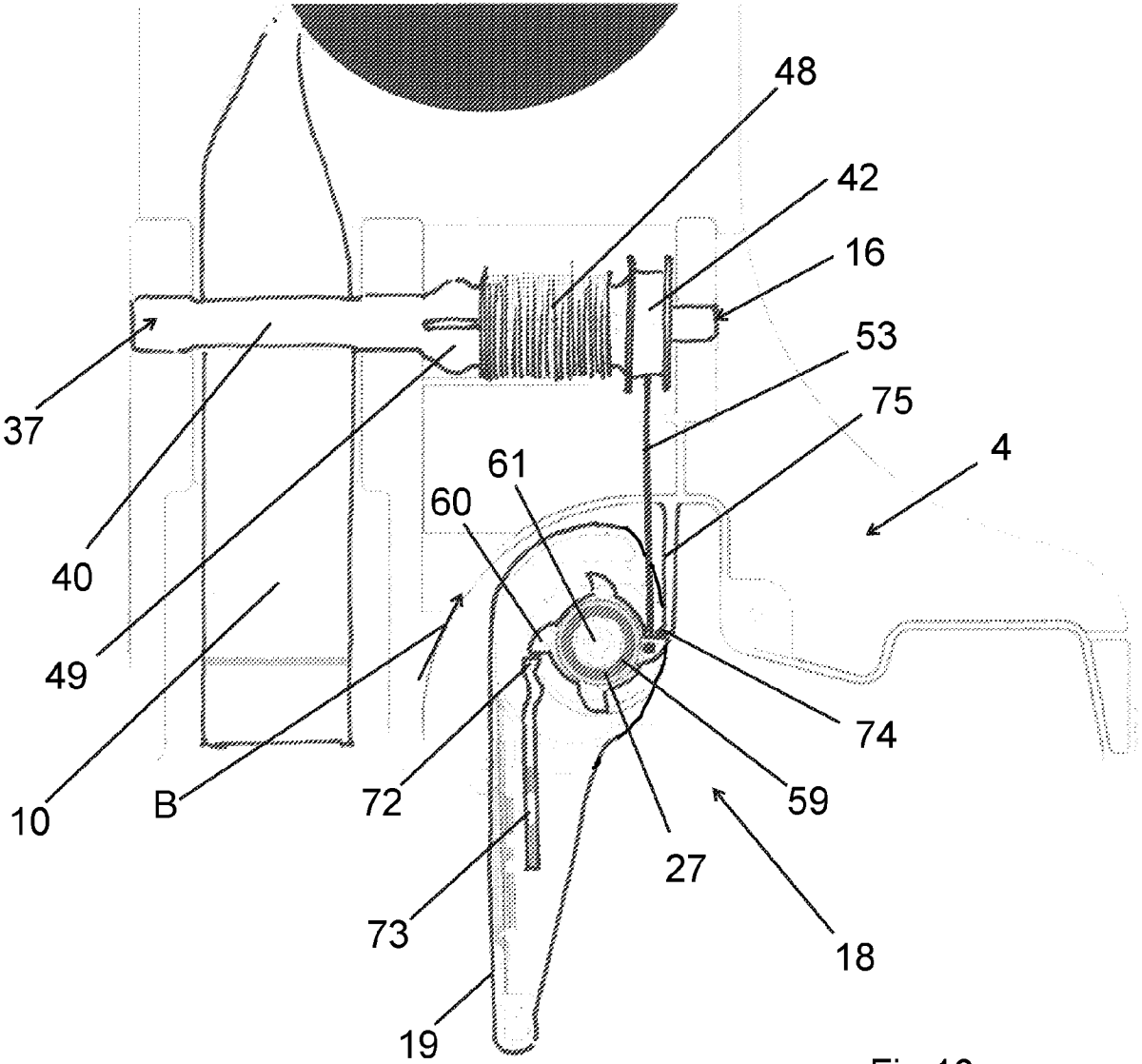

The lever 19 is operated by being pivotally moved about the principal axis 61 from a rest position (see FIGS. 2, 3, 7, 8 and 12) to a projecting position (see FIGS. 4, and 10). The lever 19 has a drive pawl 72 (see FIGS. 7 to 11) to engage the ratchet teeth 60 and drive the ratchet spool 59.

A first return element in the form of a first coil return spring 68 (see FIGS. 2 and 3) is provided between the lever 19 and the body 4 to return the lever 19 from the projecting position to the rest position.

The lever 19 has a first resilient arm 73 on which the drive pawl 72 is provided. The body 4 carries a latching pawl 74 (see FIGS. 7 to 11) on a second resilient arm 75.

A tension limitation member in the form of a flexible elongate linkage 53 extends between the ratchet spool 59 and the slotted member 37, thereby linking the ratchet spool 59 to the slotted member 37. The linkage 53 also acts as a transmission arrangement to transmit the driving force on the ratchet spool 59 to the slotted member 37.

Figure 6:
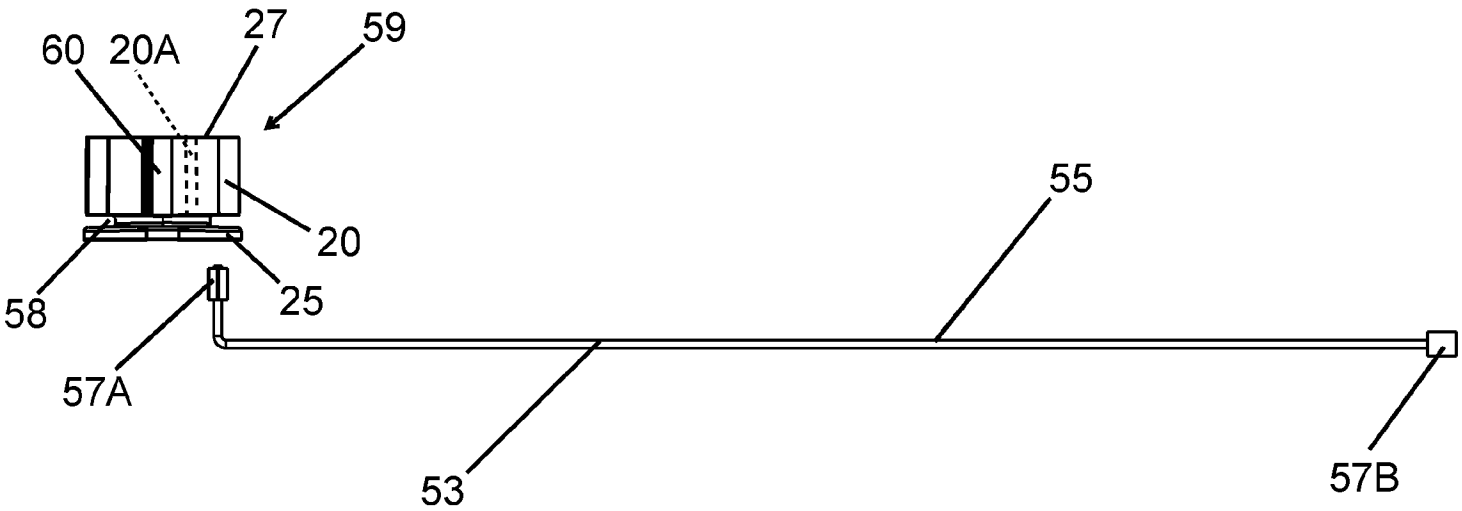
FIG. 6 is a side view showing the ratchet spool and a transmission arrangement separate from each other.
Figure 7:
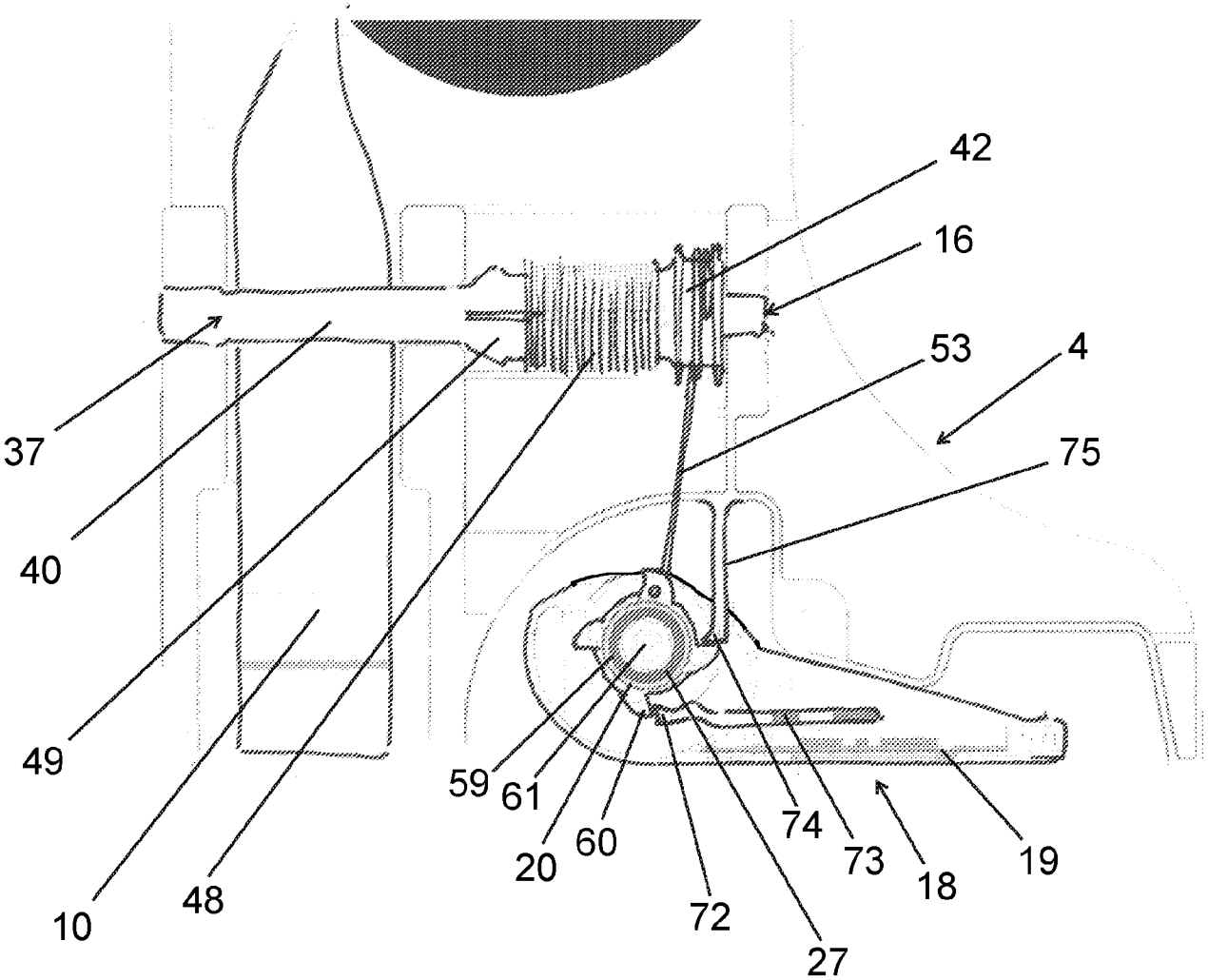
FIG. 7 is a sectional top plan view of the winding assembly.

As shown in FIG. 6, the elongate linkage 53 comprises an elongate portion 55 and a first connecting member 57A provided at one end of the elongate portion 55. A second connecting member 57B is provided at the opposite end of the elongate portion 55.

The slotted member 37 has an elongate spindle 40 defining a slot 38 through which the strap 10 passes. The slotted member 37 also has a ribbed portion 49 on the spindle 40, and a second attaching formation in the form of a second annular groove formation 42.

The second annular groove formation 42 has a second diameter. The ribbed portion 49 is provided between the second annular groove formation 42 and the spindle 40. The spindle 40 has a third diameter.

The main part 20 defines a through bore 20A (shown in broken lines in FIG. 6), which opens into the first annular groove formation 58. The first connecting member 57A is received in the through bore 20A to connect the elongate linkage 53 to the ratchet spool 59.

The second connecting member 57B is received in a hole (not shown) defined by the second annular groove formation 42 of the slotted member 37.

Thus, one end of the flexible elongate linkage 53 is attached to the ratchet spool 59. The opposite end of the flexible elongate linkage 53 is attached to the slotted member 37.

The flexible elongate linkage 53 is in the form of a wire rope, and is wound around the first and second annular groove formations 58, 42, as discussed in more detail below.

Figure 2:
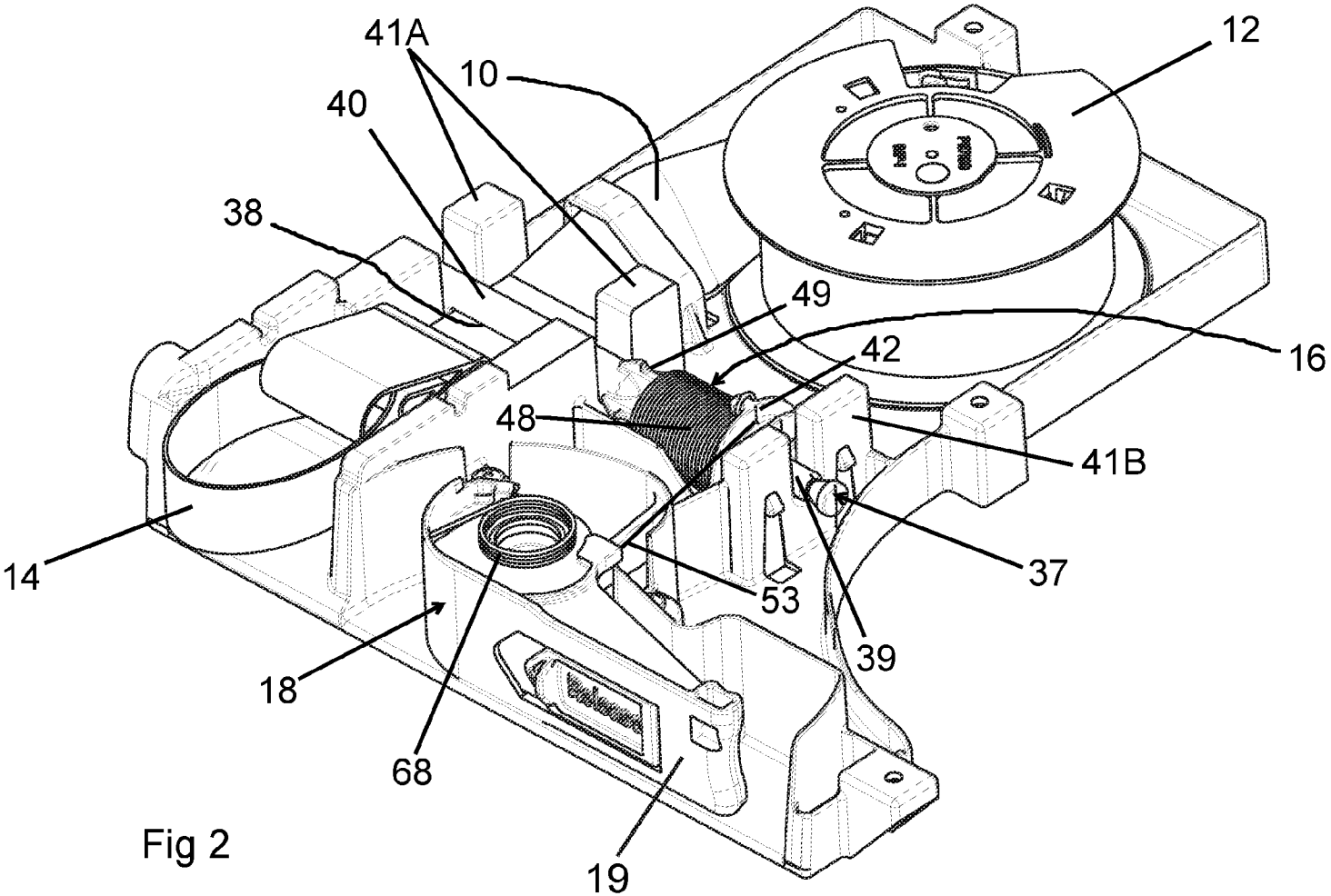
FIG. 2 is a perspective view of a winding assembly for use in the lid shown in FIG. 1.

A second return element in the form of a second coil spring 48 encircles the ribbed portion 49 of the slotted member 37 (see FIGS. 2, 3 and 4).

The opposite ends of the second coil spring 48 respectively engage the body 4 and the ribbed portion 49, thereby urging the slotted member 37 to the position shown in FIGS. 2 and 3 in which the strap 10 is not wound around the spindle 40 and can pass through the slot 38.

Figure 8:
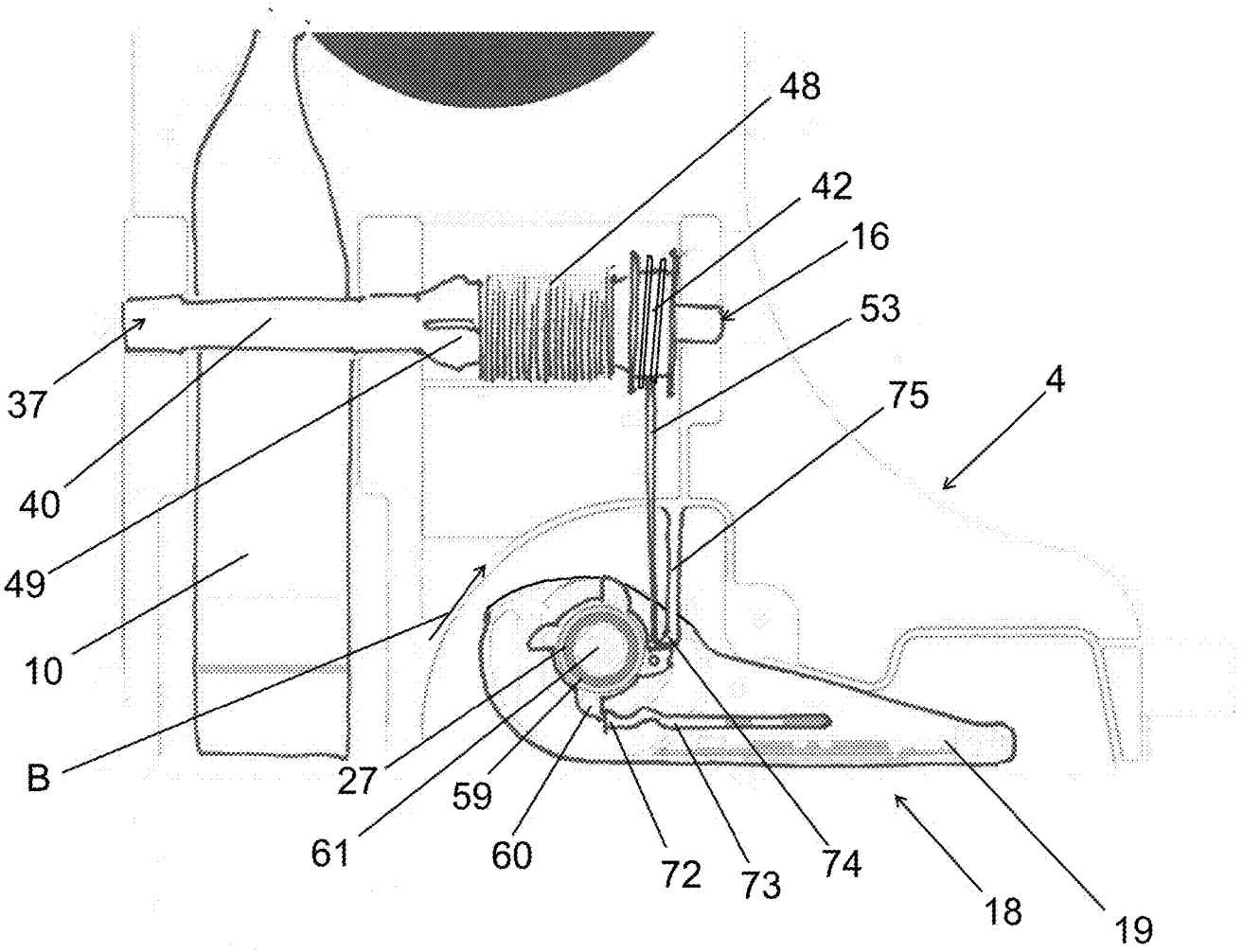
FIGS. 8 to 12 show stages during the operation of the winding assembly.

In order to tighten the strap 10, the lever 19 is moved from the rest position shown in FIG. 8, through an intermediate position shown in FIG. 9 to the projecting position shown in FIG. 10. As this movement occurs, the drive pawl 72 engages one of the ratchet teeth 60 to rotate the ratchet spool 59, as indicated by the arrows B in FIGS. 8 to 10.

The rotation of the lever 19 from the rest position to the projecting position rotates the ratchet spool 59 in a driving direction. This rotation is substantially 90°. The rotation of the ratchet spool in the driving direction winds the flexible elongate linkage 53 onto the first annular groove formation 58 of the ratchet spool 59. The winding of the elongate linkage 53 onto the first annular groove formation 58 is a movement of the elongate linkage 53 from a release condition to a tension applying condition. As a result of the winding of the elongate linkage 53 onto the first annular groove formation 58, the slotted member 37 is rotated to wind the strap 10 around the spindle 40, thereby applying tension to the strap 10.

As the ratchet spool 59 is rotated by the lever 19, the resilient arm 75 is deformed to a non-deformed position so that the latching pawl 74 can move out of the way of the ratchet teeth 60. This allows the ratchet teeth 60 to move across the latching pawl 74 as the ratchet spool 59 rotates.

When the lever 19 reaches the projecting position, the latching pawl 74 is sprung under the action of the resilient arm 75 back to its non-deformed position. In the non-deformed position, the latching pawl 74 engages one of the ratchet teeth 60.

Figure 11:
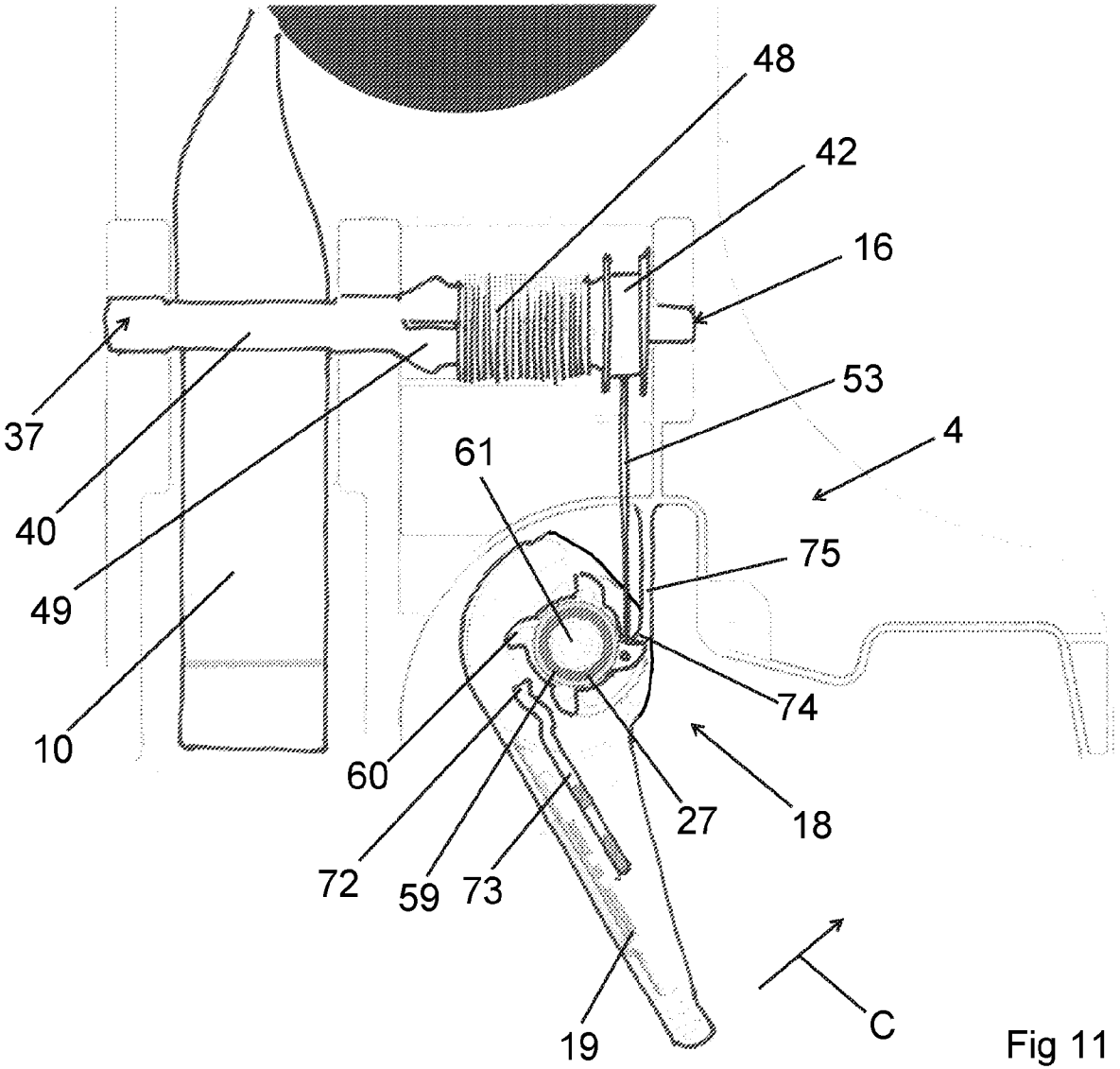
Figure 12:
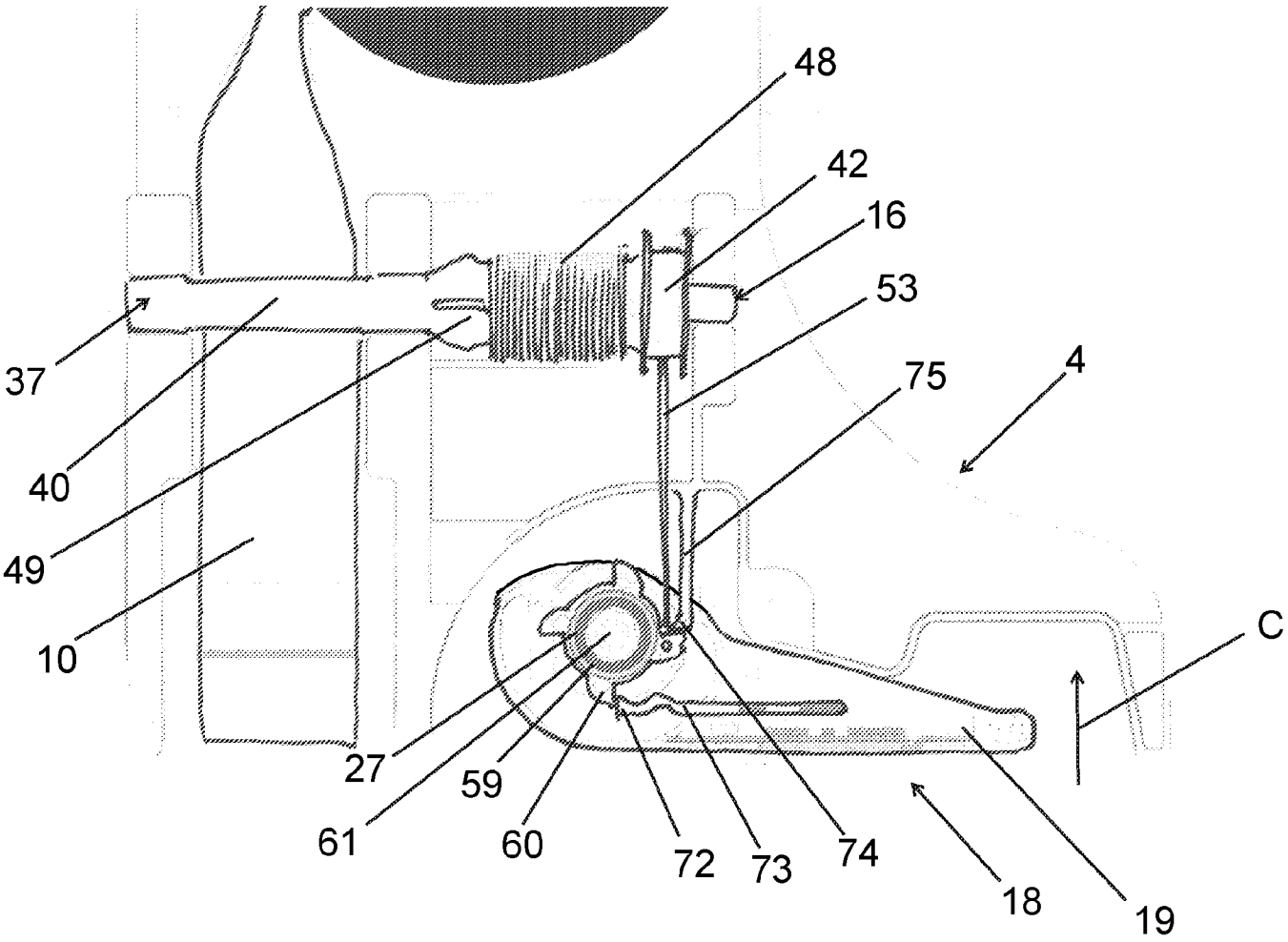

The lever 19 can then be returned to the rest position, as shown in FIGS. 11 and 12, and indicated by the arrows C. As the lever 19 returns to the rest position, the engagement of the latching pawl 74 with one of the ratchet teeth 60 prevents rotation of the ratchet spool 59.

During this return movement of the lever 19, the resilient arm 73 deforms so that the drive pawl 72 can move out of the way of the ratchet teeth 60, to allow the ratchet teeth 60 to move across the drive pawl 72, and the lever 19 moves relative to the ratchet spool 59.

The lever 19 can be oscillated between the rest and projecting positions (as indicated by the double headed arrow A in FIG. 4) to cause the ratchet spool 59 to wind the flexible elongate linkage 53 into the first annular groove formation 58 from the second annular groove formation 42. This rotates the spindle 40 to wind the strap 10 on to the slotted member 37, thereby tensioning the strap 10 against the pallet 3.

The flexible elongate linkage 53 has a length that is predetermined to ensure that the tension created in the strap 10 does not exceed a desired amount. The length of the flexible elongate linkage 53 is selected so that the flexible elongate linkage 53 is fully unwound from the second annular groove formation 42 when the desired tension has been reached.

The attachment of the flexible elongate linkage 53 to the ratchet spool 59 and to the slotted member 37 means that, when the flexible elongate linkage 53 is fully unwound, any further attempt to drive the ratchet spool 59 by means of the lever 19 simply increases the tension in the flexible elongate linkage 53. This prevents and any further rotation of the ratchet spool 59, and further prevents further tightening of the strap 10.

The provision of four ratchet teeth 60 equispaced around the ratchet spool 59 means that there is a large gap between the teeth 60. The effect of this is that, when the elongate linkage 53 has been fully unwound from the second annular groove formation 42, the latching pawl 74 engages one of the ratchet teeth 60. In this position, the predetermined maximum tension is applied to the strap 10.

Further movement of the lever 19 will not result in the latching pawl 58 engaging the next ratchet tooth 60. Instead, the user will have to release the lever 19, thereby allowing the ratchet spool 59 to move back to its previous position, in which the latching pawl 74 engages the previously engaged ratchet tooth 60.

Therefore, the provision of four ratchet teeth 60 prevents tension in the elongate linkage 53 being increased beyond a predetermined maximum for prolonged periods of time, thereby preventing damage being caused to the winding assembly 16.

Thus, the flexible elongate linkage 53 acts as a stop to prevent further rotation of the ratchet spool 59. It has been found desirable that the lever 19 should be pivoted four times between the rest and projecting positions to unwind the flexible elongate linkage 53 fully from the second annular groove formation 42. This causes the ratchet spool 59 to be rotated substantially 360°.

When the flexible elongate linkage 53 is fully unwound as described in the immediately preceding paragraph, the user can release the lever 19, thereby allowing it to be rotated by the return spring 68 until one of the teeth 60 is engaged by the latching pawl 74, thereby holding the ratchet spool 59 in place.

When it is desired to release the strap 10, the latching pawl 74 can be released from engagement with the tooth 60. A suitable mechanism for effecting such release is described in published patent application No. GB2402380 A.

The provision of a flexible elongate linkage 53 of a predetermined length allows it to act as a stop for the lever 19, and has the effect of ensuring that the strap 10 is not overtightened.

The provision of a ratchet spool 59 having four teeth 60, allows the ratchet spool 59 to be returned by the return spring 68 by up to 90° before one of the teeth 60 is engaged by the latching pawl 74, thereby allowing the strap 10 to relax to its desired tension.

Thus, the extent to which the winding assembly 16 can apply tension to the strap 10 is determined by the length of the elongate linkage 53. Where the second and third diameters are fixed, the predetermined maximum tension that can be applied to the strap 10 when in use is dependent upon the length of the elongate linkage 53.

What is claimed is:

1. A winding assembly comprising:

a ratchet spool rotatable about a principal axis, said ratchet spool having a main part and a plurality of ratchet teeth arranged circumferentially around the main part;

a tensioner for tensioning an elongate article;

a driver to engage the ratchet teeth of the ratchet spool and rotate the ratchet spool in a driving direction about said principal axis to apply tension to the elongate article; and a flexible elongate linkage between the ratchet spool and the tensioner to limit the tension applied to the elongate article;

wherein the ratchet spool has a first attaching formation to attach the tension limitation member to the ratchet spool, and the tensioner has a second attaching formation to attach the flexible elongate linkage to the tensioner;

wherein the flexible elongate linkage is movable between a release condition and a tension applying condition, whereby a predetermined maximum tension is applied to the elongate article in said tension applying condition;

wherein the flexible elongate linkage is wound around the second attaching formation when the flexible elongate linkage is in the release condition; and wherein the flexible elongate linkage is fully unwound from the second attaching formation when the flexible elongate linkage is in the tension applying condition.

2. A winding assembly according to claim 1, wherein the flexible elongate linkage is moved to the tension applying condition when the ratchet spool is rotated in the driving direction.

3. A winding assembly according to claim 1, comprising a force transmitter between the ratchet spool and the tensioner.

4. A winding assembly according to claim 3, wherein the first attaching formation comprises a first annular groove formation defined by the main part, and the flexible elongate linkage is being received in the first annular groove formation when the ratchet spool is rotated in the driving direction.

5. A winding assembly according to claim 3, wherein the flexible elongate linkage extends circumferentially around the main part, and the flexible elongate linkage is wound around the first attaching formation when the ratchet spool is rotated in the driving direction.

6. A winding assembly according to claim 3, wherein the second attaching formation comprises a second annular groove formation, the tension limitation member extending around the second annular groove formation when the tension limitation member is in the release condition.

7. A winding assembly according to claim 3, wherein the first attaching formation includes a first bore defined by the ratchet spool, the first bore opening into the first annular groove, and an end region of the flexible elongate linkage is received in the first bore to attach the tension limitation member to the ratchet spool.

8. A winding assembly according to claim 3, wherein the second annular groove comprises a second bore defined by the tensioner, the bore opening into the second annular groove formation, and an end region of the flexible elongate linkage is received in the second bore to attach the tension limitation member to the tensioner.

9. A winding assembly according to claim 3, wherein the ratchet spool is drivable in the driving direction to fully unwind the flexible elongate linkage from the tensioner and, when so unwound, further driving of the ratchet spool causes tension to be applied to the flexible elongate linkage, preventing further rotation of the ratchet spool.

10. A winding assembly according to claim 3, wherein the flexible elongate linkage is of a length predetermined to limit the extent to which the driver can rotate the ratchet spool, the predetermined length of the flexible elongate linkage permitting only a predetermined number of rotations of the ratchet spool.

11. A winding assembly according to claim 10, wherein the flexible elongate linkage is fully unwound from the second annular groove after said predetermined number of rotations of the ratchet spool, and tension is applied to the flexible elongate linkage, thereby preventing further rotation of the ratchet spool.

12. A winding assembly according to claim 10, wherein the predetermined length of the flexible elongate linkage is selected such that said predetermined number of rotations of the ratchet spool drives the tensioner a predetermined number of rotations of the tensioner.

13. A winding assembly according to claim 1, wherein the plurality of ratchet teeth comprise between four and ten of the ratchet teeth.

14. A winding assembly according to claim 1, wherein each ratchet tooth is spaced from adjacent ratchet teeth by a distance such that when the flexible elongate linkage is fully unwound from the tensioner, tension is applied to the flexible elongate linkage, thereby preventing further rotation of the ratchet spool.

15. A winding assembly according to claim 1, comprising a ratchet arrangement having an operating lever, and the ratchet arrangement comprising a drive pawl to engage the ratchet teeth, the operating lever being operable to effect movement of the drive pawl into engagement with the ratchet teeth.

16. A winding assembly according to claim 1, further comprising an operating member, wherein the operating member lever is movable from an inoperative position to an operative position, movement of the operating member from the inoperative position to the operative position causing the ratchet arrangement to engage one of the ratchet teeth and rotate the ratchet spool.

17. A lid comprising:

a body;

an elongate article within the body, the elongate article being movable between a retracted condition in which the elongate article is retracted within the body, and an extended condition in which the elongate article extends from the body; and a winding assembly as claimed in claim 1 operable on the elongate article.

18. A method of using a winding assembly as claimed in claim 1, wherein the transmission arrangement comprises the flexible elongate linkage; the method comprising: driving the ratchet spool to fully unwind the flexible elongate linkage from the tensioner whereby, when so unwound, further driving of the ratchet spool causes tension to be applied to the flexible elongate linkage, thereby preventing further rotation of the ratchet spool.

19. A winding assembly for winding an elongate article, said winding assembly comprising:

a ratchet spool rotatable about a principal axis;

a tensioner;

a driver to rotate the ratchet spool in a driving direction about said principal axis to apply tension to the elongate article; and a flexible elongate linkage between the ratchet spool and the tensioner;

wherein the ratchet spool has a first annular groove, and the tensioner has a second annular groove;

wherein the flexible elongate linkage is movable between a release condition and a tension applying condition, whereby a predetermined maximum tension is applied to the elongate article in said tension applying condition;

wherein the flexible elongate linkage is wound around the second annular groove when the flexible elongate linkage is in the release condition; and wherein the flexible elongate linkage is fully unwound from the second annular groove when the flexible elongate linkage is in the tension applying condition.

* * * * *